US006334340B1

(12) United States Patent
Kegler et al.

(10) Patent No.: US 6,334,340 B1
(45) Date of Patent: Jan. 1, 2002

(54) LIQUIFIED GAS DRY-CLEANING MACHINE WITH CONVERTIBLE INSTALLATION CONFIGURATION

(75) Inventors: Andrew F. Kegler, Ripon; Gregory L. Malchow; Stephen L. Harris, both of Oshkosh, all of WI (US)

(73) Assignee: Alliance Laundry Systems LLC, Ripon, WI (US)

( * ) Notice: Subject to any disclaimer, the term of this patent is extended or adjusted under 35 U.S.C. 154(b) by 0 days.

(21) Appl. No.: 09/415,906

(22) Filed: Oct. 8, 1999

(51) Int. Cl.[7] ..... D06B 23/20
(52) U.S. Cl. ..... 68/18 R; 68/18 C; 68/13 R
(58) Field of Search ..... 68/18 C, 18 F, 68/18 R, 13 R; 8/149, 148

(56) References Cited

U.S. PATENT DOCUMENTS 4,601,181 A * 7/1986 Privat
5,415,890 A * 5/1995 Koliber et al.
5,467,492 A 11/1995 Chao et al.
5,635,070 A * 6/1997 Allington et al.
5,651,276 A 7/1997 Purer et al.
5,701,627 A * 12/1997 Matsumura et al.
5,863,510 A * 1/1999 Pozniak et al.
5,904,737 A * 5/1999 Preston et al.
5,970,554 A * 10/1999 Shore et al.
6,049,931 A * 4/2000 McClain et al.
6,050,112 A * 4/2000 Walker ..... 68/18 C
6,122,941 A * 9/2000 McClain et al. .....

* cited by examiner

*Primary Examiner*—Frankie L. Stinson
(74) *Attorney, Agent, or Firm*—Leydig, Voit & Mayer, LTD

(57) ABSTRACT

A liquified gas dry cleaning system is provided which includes a cleaning vessel for containing a pressurized cleaning fluid and a storage tank for receiving and storing a cleaning fluid supply. The system also includes a cleaning fluid recovery still for separating contaminants from the cleaning fluid along with a filtration system for filtering contaminants from the cleaning fluid. A purge tank for receiving gaseous cleaning fluid which is in fluid communication with the cleaning vessel is also provided. The cleaning vessel, storage tank, purge tank, solvent recovery still and filtration system are arranged in a plurality of modules. The modules are in fluid communication with each other through a fluid line for carrying liquified cleaning fluid and a gas line for carrying gaseous cleaning fluid. The fluid line and gas line each include a respective junction for permitting separation of the modules. The fluid line junction and the gas line junction are disposed and configured such that the modules can be assembled in different configurations without any requiring any rerouting of the liquid and gas lines.

17 Claims, 5 Drawing Sheets

LIQUIFIED GAS DRY-CLEANING MACHINE WITH CONVERTIBLE INSTALLATION CONFIGURATION

FIELD OF THE INVENTION

The present invention relates to dry-cleaning systems and, more particularly, to a liquified gas dry-cleaning system which is readily converted into different assembled configurations.

BACKGROUND OF THE INVENTION

Known dry-cleaning processes consist of a wash, rinse, and drying cycle with solvent recovery. Garments are loaded into a basket in a cleaning drum and immersed in a dry-cleaning fluid or solvent, which is pumped into the cleaning drum from a base tank. Conventional dry-cleaning fluids include perchloroethylene (PCE), petroleum-based or Stoddard solvents, CFC-113, and 1,1,1-trichloroethane, all of which are generally aided by a detergent. The solvent is used to dissolve soluble contaminants, such as oils, and to entrain and wash away insoluble contaminants, such as dirt.

The use of these conventional solvents, however, poses a number of health and safety risks as well as being environmentally hazardous. For example, halogenated solvents are known to be environmentally unfriendly, and at least one of these solvents, PCE, is a suspected carcinogen. Known petroleum-based solvents are flammable and can contribute to the production of smog. Accordingly, dry cleaning systems which utilize dense phase fluids, such as liquid carbon dioxide, as a cleaning medium have been developed. An apparatus and method for employing liquid carbon dioxide as the dry-cleaning solvent is disclosed in U.S. Pat. No. 5,467,492, entitled "Dry-Cleaning Garments Using Liquid Carbon Dioxide Under Agitation As Cleaning Medium". A similar dry cleaning apparatus is also disclosed in U.S. Pat. No. 5,651,276.

These systems pose a number of other problems, particularly in relation to the high operating pressures necessary for maintaining the gas in a liquid state. For example, the various pressurized components of the system must be constructed with thick, heavy walled structures to withstand the elevated pressures encountered during the dry cleaning operation. These bulky structures consume a significant amount of space. For instance, a liquified gas dry-cleaning machine can have dimensions which exceed eight feet in length and the weight of the machine can exceed 6,000 pounds. As will be appreciated, equipment of this size and weight can be difficult to install. Moreover, in order to encourage dry cleaning operators to convert to liquid carbon dioxide dry cleaning systems, these new systems must be able to be placed into facilities and locations designed for existing dry-cleaning equipment. However, due to the neighborhood nature of many dry cleaning operations, substantial space restrictions can exist at many dry-cleaning facilities. These space restrictions can exacerbate the difficulties associated with installing the liquified gas dry-cleaning equipment and, in some cases, could preclude the installation of such a system in a particular location.

The size and weight of liquified gas dry-cleaning equipment also can make it very difficult to ship. For example, heavy lifting equipment must be provided to the move dry-cleaning machine. In addition, in order to reach a particular installation location, it may be necessary to move the dry-cleaning machine through tight hallways and narrow doorways. Obviously, because of the size and weight of the equipment, this can be very difficult and, in some instances, also could preclude the installation of the system.

OBJECTS AND SUMMARY OF THE INVENTION

In view of the foregoing, a general object of the present invention is to overcome the problems associated with shipping and installing liquified gas dry-cleaning systems.

A related object of the present invention is to provide a liquified gas dry-cleaning machine which is adapted for more flexible installation so as to enable more efficient utilization of space in a particular installation location.

A more specific object of the present invention is to provide a liquified gas dry-cleaning machine which is readily converted into different assembled configurations so as to conform more easily to the space requirements of a particular installation location.

Another object of the present invention is to provide a dry-cleaning machine of the foregoing type having a modular design that makes the machine easier to ship and handle prior to installation.

These and other features and advantages of the invention will be more readily apparent upon reading the following description of a preferred exemplary embodiment of the invention and upon reference to the accompanying drawings wherein:

While the invention will be described and disclosed in connection with certain preferred embodiments and procedures, it is not intended to limit the invention to those specific embodiments. Rather it is intended to cover all such alternative embodiments and modifications as fall within the spirit and scope of the invention.

DETAILED DESCRIPTION OF THE PREFERRED EMBODIMENT

Figure 1:
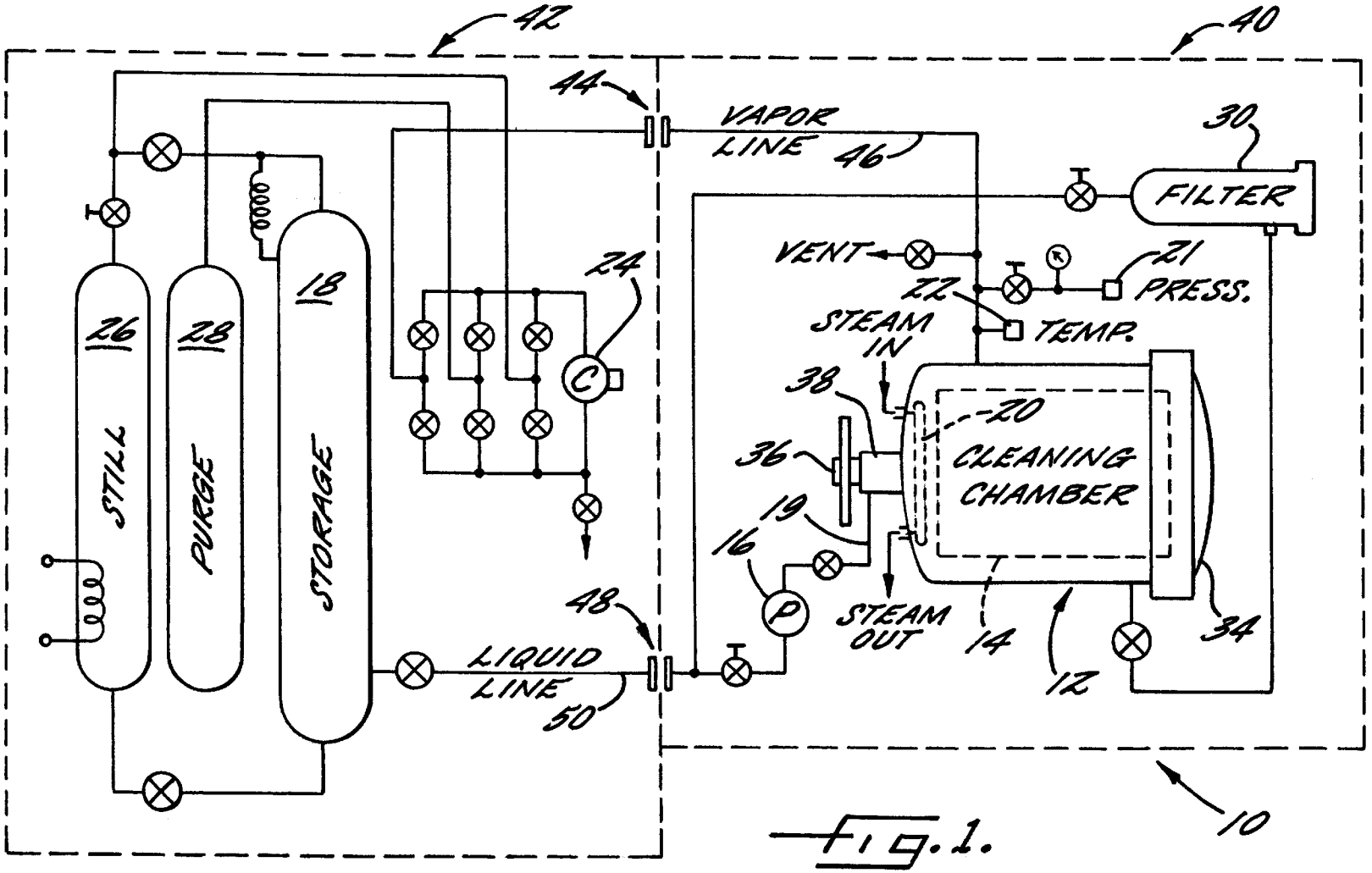
FIG. 1 is a schematic diagram of an illustrative liquified gas dry-cleaning machine in accordance with the present invention.

Referring now more particularly to FIG. 1 of the drawings, there is shown a schematic block diagram of an illustrative liquified gas, dry-cleaning machine 10 embodying the present invention. In general, the dry-cleaning machine 10 includes a cleaning vessel 12 having a basket 14 rotatably disposed therein for containing items to be cleaned. A liquid wash bath derived from a liquifiable gas, such as carbon dioxide, is used as the dry-cleaning solvent. A pump 16 is provided for directing the wash bath from a gas supply storage tank 18 and through an inlet line 19 into the pressure vessel 12. The cleaning vessel 12 is equipped with a steam heater 20, pressure sensor 21, and temperature sensor 22 to aid in temperature and pressure control for properly maintaining the wash bath in liquid phase during the dry-cleaning cycle.

The basic operation of a liquified gas dry-cleaning system is known in the art, as reflected by U.S. Pat. Nos. 5,651,276, 5,467,492, and 5,651,276, the disclosures of which are incorporated herein by reference. After the basket 14 is loaded with items, such as garments, for cleaning, the pump 16 charges the cleaning vessel 12 with a wash bath drawn from the storage tank 18, which functions as the cleaning solvent during a drying cycle. Once charged with the liquid carbon dioxide agitation may be applied to aid in the cleaning of the items. This agitation may be accomplished through the use of jet manifolds (not shown) which are supported on longitudinally extending mixing baffles arranged within the basket as disclosed in commonly assigned application Ser. No. 09/338,292, the disclosure of which is incorporated herein by reference. During the wash and rinse cycles, soluble contaminants dissolve in the liquid carbon dioxide. Upon completion of the dry cleaning cycle, the wash bath is drained from the cleaning vessel 12.

Once the wash and rinse cycles have been completed, the now contaminated liquid carbon dioxide wash bath is drained from the cleaning vessel 12 during a drying/draining cycle. For removing contaminants from the liquid carbon dioxide during the wash and rinse cycles, the liquid carbon dioxide preferably is cycled from the cleaning vessel 12 to the solvent recovery still 26 which functions to vaporize the liquid carbon dioxide to separate and concentrate the precipitates. During such processing, the clean gaseous carbon dioxide is directed to a condenser where it is reliquified and then returned to the storage tank 18. The liquified carbon dioxide is circulated through the apparatus by the pump 16.

For removing wash bath vapors from the cleaning vessel 12, a compressor 24 is provided to pump gaseous carbon dioxide from the cleaning vessel 12 to a condenser 27 where it is condensed back into liquid phase and then redirected to the storage tank 18. The gaseous carbon dioxide typically is evacuated from the cleaning vessel 12 and directed to the condenser 27 during the washing and rinse cycles and upon completion of the washing operation prior to opening the cleaning vessel 12 and removing the cleaned items. In order to control the pressure and temperature within the cleaning vessel 12, carbon dioxide may be quickly discharged from the cleaning vessel 12 to the purge tank 28 without the need for the compressor 24. Moreover, the purge tank 28 also provides a source of low pressure, gaseous carbon dioxide which can be used to purge the cleaning vessel 12 of air before the wash cycle is commenced as disclosed in commonly assigned U.S. application Ser. No. 09/338,292, the disclosure of which is incorporated herein by reference For removing non-soluble contaminants from the liquid carbon dioxide, the liquid carbon dioxide is circulated through a filtration system including, in the illustrated embodiment, a separator and filter unit 30. In addition, the cleaning vessel 12, in this instance, includes an internal lint filter for removing lint and coarse solids from the wash bath as it is drained from the cleaning vessel as disclosed in commonly assigned application Ser. No. 09/338,653 the disclosure of which is incorporated herein by reference.

Figure 2:
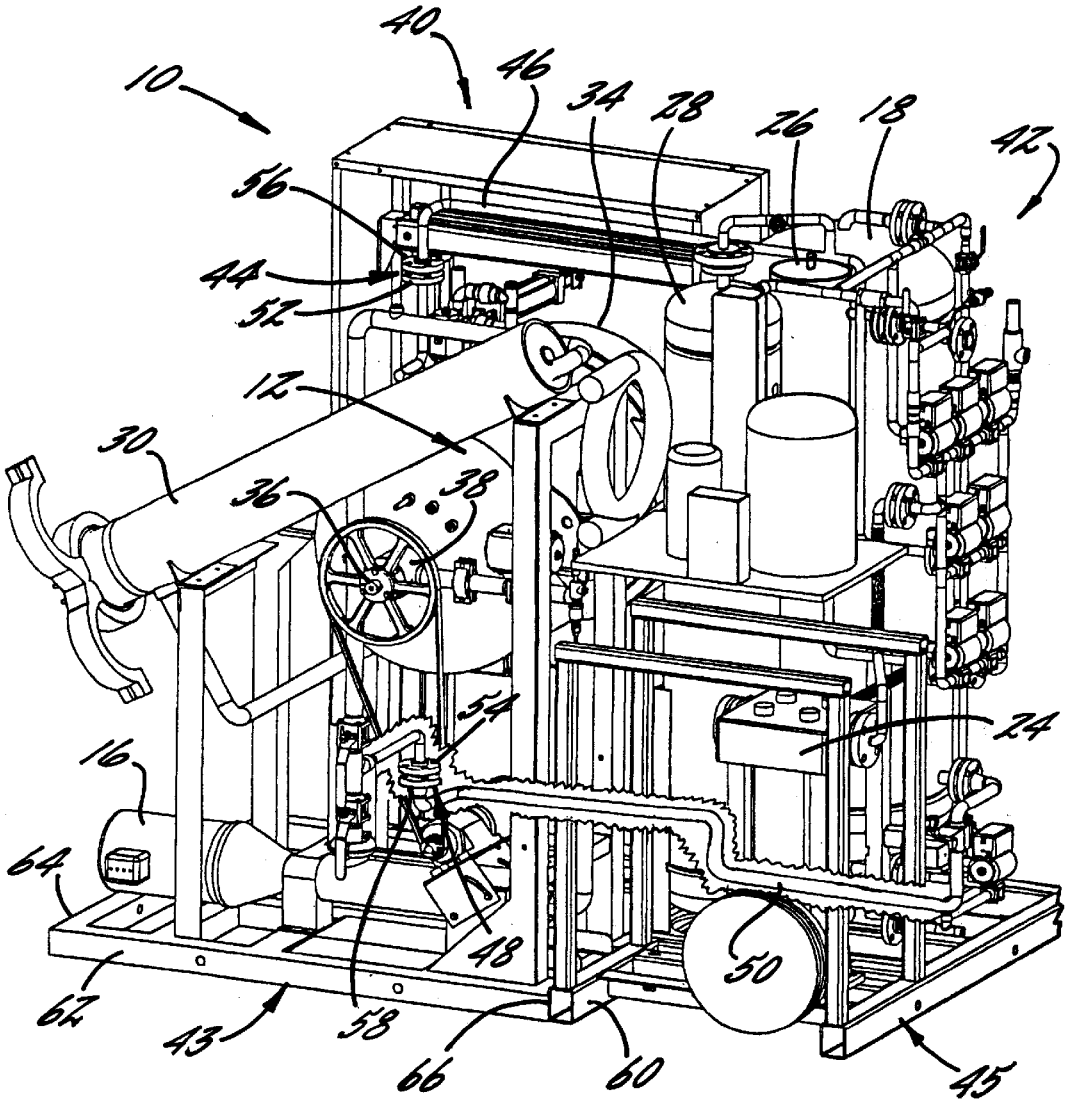
FIG. 2 is a rear perspective view of the liquified gas dry-cleaning machine of FIG. 1 with the cleaning vessel module and the tank module arranged in side-to-side relation.

The illustrated cleaning vessel 12, as best depicted in FIG. 2 comprises an elongated housing having a rounded end wall integrally formed at one end and a removable door 35 34, also of generally rounded configuration, releasably secured at the other end. The housing defines a cylindrical cleaning chamber within which the rotary basket 14 is disposed. For supporting the basket 14 for rotating movement relative to the cleaning vessel 12, the basket has an outwardly extending support and drive shaft 36 extending through the end wall of the cleaning vessel. The drive shaft 36, which preferably is driven by a bi-directional motor, is rotatably supported in an annular collar or bushing 38. For opening the door 34 to permit loading and unloading of items into the cleaning vessel 12, an apparatus may be provided for automatically unlocking, removing and lowering the door as disclosed in commonly assigned application Ser. No. 09/338,590, the disclosure of which is incorporated herein by reference.

In accordance with an important aspect of the present invention, to facilitate shipping and handling, the dry-cleaning machine 10 has a modular construction which allows the unit to be shipped in separate pieces to the particular location in which it is to be installed where the unit can then be assembled quickly and easily. As will be appreciated, having the capability to break the dry-cleaning machine into separate modules permits the unit to be transported through significantly tighter doors and corridors than would be possible if the unit had to be moved in a single piece. Moreover, if each module is lifted separately, the required capacity of the lifting equipment can be significantly reduced. To this end, in the illustrated embodiment, the dry-cleaning machine 10 is separable into a cleaning vessel module 40 and a tank module 42. The cleaning vessel module 40, in this case, includes as primary components the cleaning vessel 12 itself, the pump 16, and the separator and filter unit 30 all of which are arranged in a respective cleaning vessel module frame 43. The tank module 42, in turn, includes as primary components, the storage tank 18, purge tank 28, compressor 24 and solvent recovery still 26 which are also arranged in a respective tank module frame 45.

Figure 5:
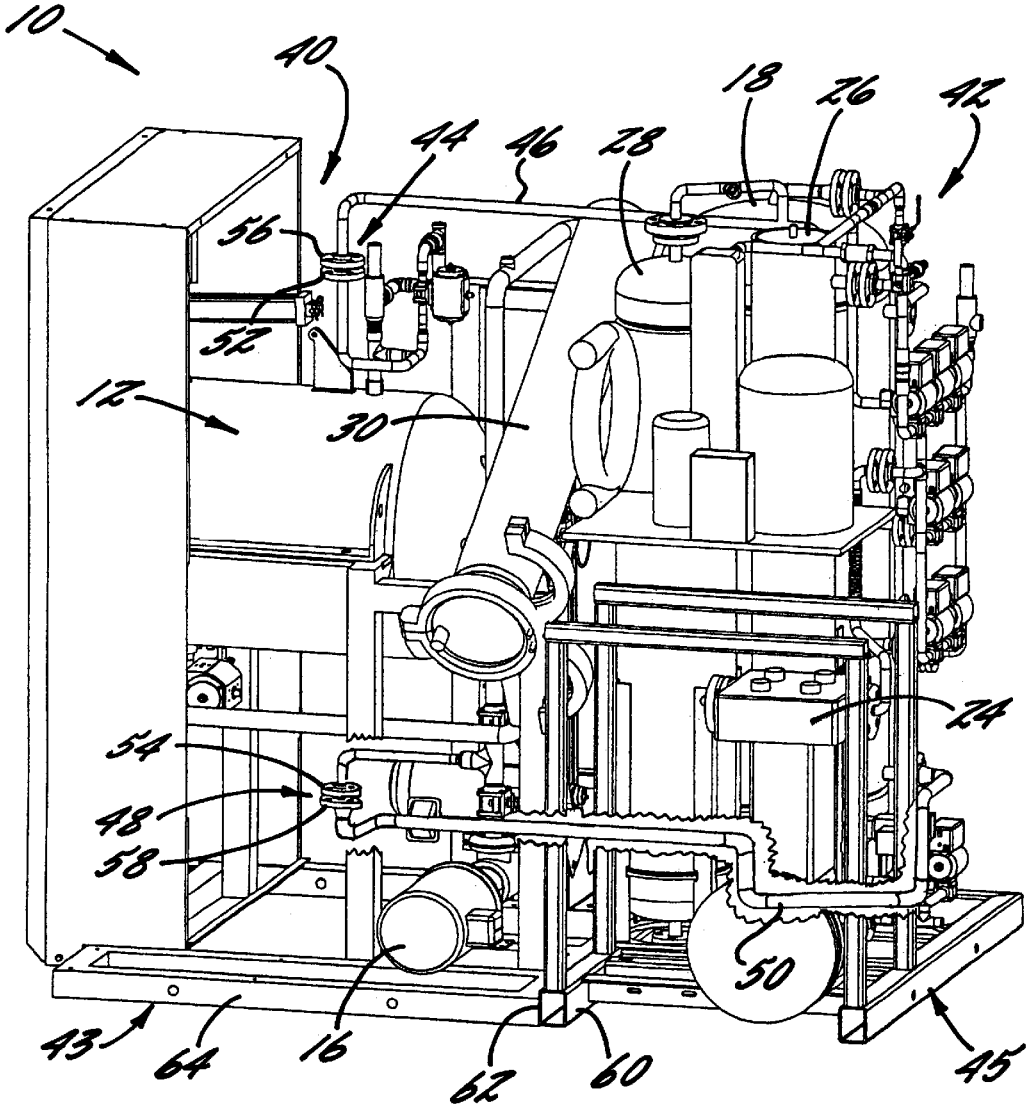
FIG. 5 is a rear perspective view of the liquified gas dry-cleaning machine of FIG. 1 with the cleaning vessel module and the tank module arranged in front-to-back relation.

To allow for passage of the cleaning fluid between the two modules, and in turn the various components of the machine, a line 46 is provided for carrying gaseous carbon dioxide vapors and a line 50 is provided for carrying liquid carbon dioxide. These two lines provide the primary links between the two modules. To permit separation of the two modules, a junction 44 is provided in the vapor line 46 and a junction 48 is provided in the liquid line 50 as shown in FIGS. 1, 2 and 5. Accordingly, the two modules can be separated simply by severing the vapor line 46 and the liquid line 50 at the respective junctions 44, 48 that are provided between the cleaning vessel and tank modules 40, 42.

Figure 3:
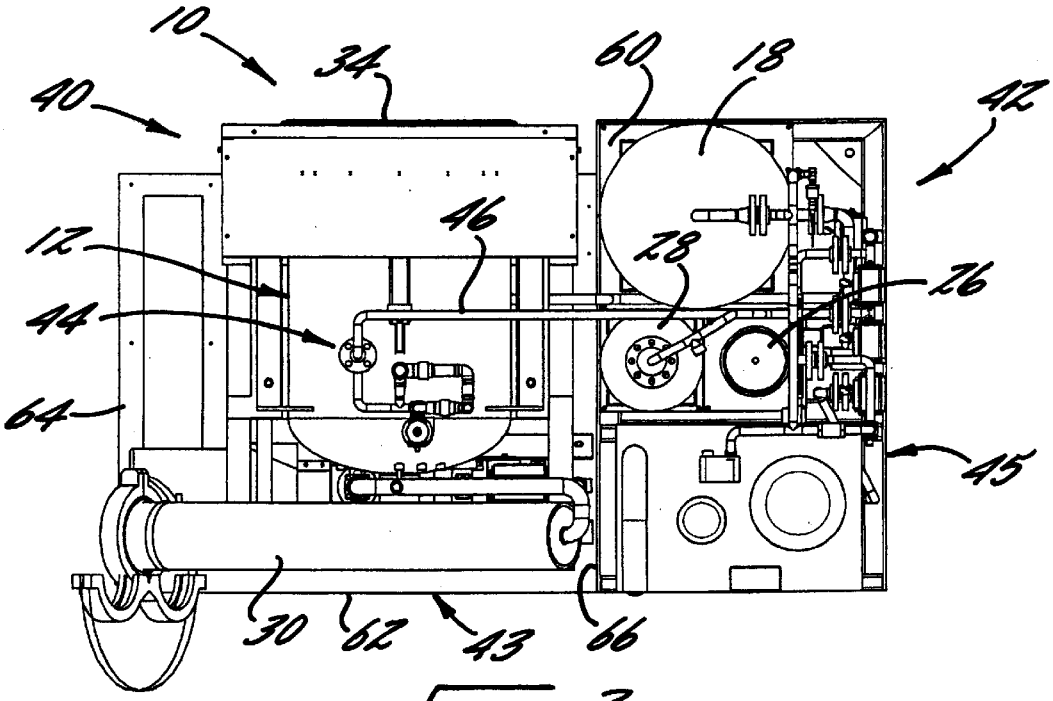
FIG. 3 is a top plan view of the liquified gas dry-cleaning machine of FIG. 1 with the cleaning vessel module and the tank module arranged in side-to-side relation.
Figure 4:
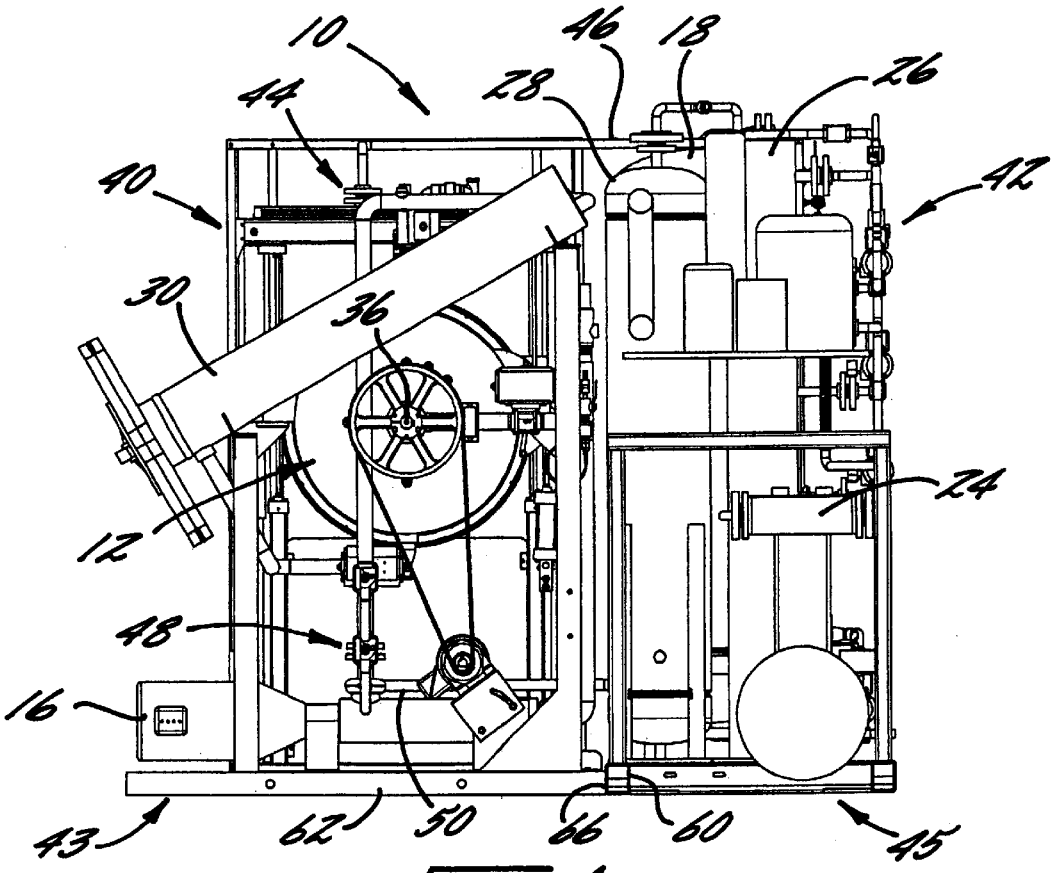
FIG. 4 is a rear elevation view of the liquified gas dry-cleaning machine of FIG. 1 with the cleaning vessel module and the tank module arranged in side-to-side relation.
Figure 6:
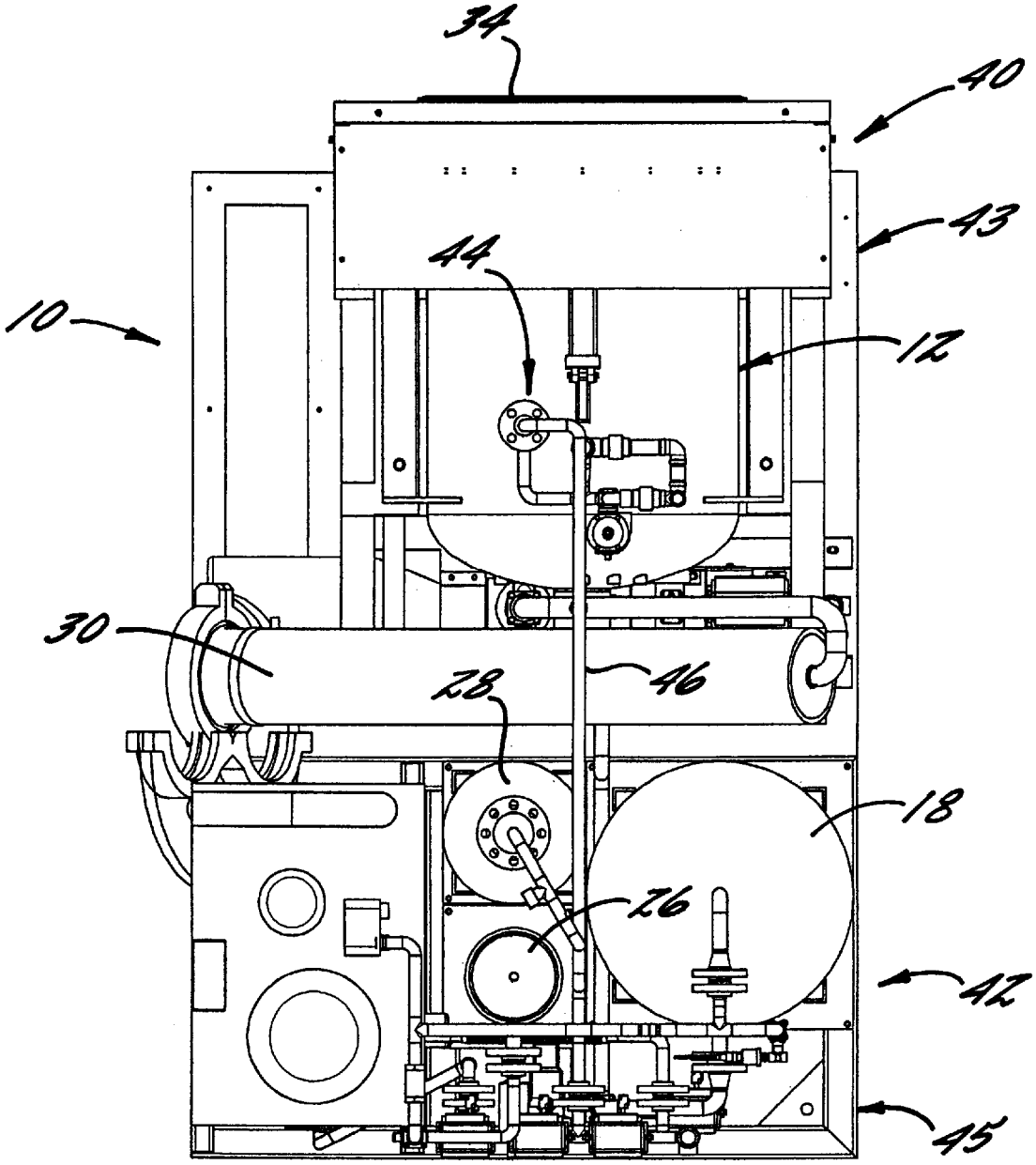
FIG. 6 is a top plan view of the liquified gas dry-cleaning machine of FIG. 1 with the cleaning vessel module and the tank module arranged in front-to-back relation.

In accordance with a further important aspect of the present invention, to permit more flexible installation, the cleaning vessel module 40 and the tank module 42 are adapted so that the dry-cleaning machine 10 can be assembled in different configurations without the need to reroute either the vapor line 46 or liquid line 50. Specifically, in this case, the cleaning vessel and tank modules 40, 42 can be arranged in adjacent relation either side-to-side as shown in FIGS. 2–4 or front-to-back as shown in FIGS. 5–6. This is accomplished by arranging the junctions between the two modules in the liquid carbon dioxide line 50 and the carbon dioxide vapor line 46 such that they define connection points that are in the same relative positions no matter which of the different installation configurations is used.

To this end, in the illustrated embodiment, horizontal flange connections 52, 54, 56, 58 (FIGS. 2 and 5) are provided on the respective ends of the cleaning vessel module portions of the carbon dioxide liquid and vapor lines and on the respective ends of the tank module portions of the vapor and liquid lines 46, 50. As shown in FIGS. 2–6, in this case, the horizontal flange connections 52, 54 on the ends of the cleaning vessel portions of the vapor and liquid lines 46, 50 are arranged along a common vertical axis within the cleaning vessel module 40. The horizontal flange connections 56, 58 on the ends of the tank module portions of the vapor and liquid lines 45, 50 are also arranged along a common vertical axis, but since the lines extend away from the tank module 42, the axis is in spaced relation to one side 60 of the tank module frame 45. Moreover, the horizontal flange connections 52, 54 on the ends of the cleaning vessel module portions of the vapor and liquid lines 46, 50 are spaced from both the rear 62 and sides 64, 66 of the frame 43 of the cleaning vessel module a distance equal to the distance the vapor and liquid lines 46, 50 extend past the side 60 of the tank module frame 45. Thus, the horizontal flange connections 52, 54, 56, 58 on the ends of the cleaning vessel module portion and the tank module portion of the liquid line 50 and the vapor line 46 will be in alignment no matter if the tank module is arranged to the side of the cleaning vessel module or behind the cleaning vessel module, as best shown in FIGS. 2 and 5.

As will be appreciated, such an arrangement of the connections allows the modules to be installed in adjacent relation either next to each other or with the tank module 42 behind the cleaning vessel module 40 simply by arranging the modules in the desired configuration and connecting the respective portions of the gaseous carbon dioxide vapor line 46 and the liquid carbon dioxide line 50 via the horizontal flanges 52, 54, 56, 58. No rerouting of the vapor and liquid lines is necessary.

Those skilled in the art will also appreciate that while in the illustrated embodiment the connections between the gas and liquid carbon dioxide lines 46, 50 are arranged so as to allow the tank module 42 to be placed to either side of the cleaning vessel module 40, the connections may be arranged so as to allow the tank module to be placed to only one side of the cleaning vessel module by arranging the connections equidistant from the back and that side of the cleaning vessel module frame 43. Likewise, while the junctions 44, 48 between the carbon dioxide vapor and liquid lines 46, 50 are arranged in the cleaning vessel module 40 when the machine is assembled, it will be appreciated that the junctions in the lines also could be arranged in the tank module 42 or the junctions could be arranged in separate modules.

From the foregoing, it can be seen that the modularly constructed dry cleaning machine of the present invention overcomes many of the problems associated with shipping and handling of the relatively large, heavy unit. Moreover, the capability of assembling the modules in different configurations enables the dry cleaning machine of the present invention to be more adaptable to the space requirements of a particular installation location.

All of the references cited herein, including patents, patent applications, and publications, are hereby incorporated in their entireties by reference.

While this invention has been described with an emphasis upon preferred embodiments, it will be obvious to those of ordinary skill in the art that variations of the preferred embodiments may be used and that it is intended that the invention may be practiced otherwise than as specifically described herein. Accordingly, this invention includes all modifications encompassed within the spirit and scope of the invention as defined by the following claims.

What is claimed is:

1. A liquified gas dry cleaning system comprising:

a cleaning vessel for containing a pressurized cleaning fluid, a storage tank for receiving and storing a cleaning fluid supply, a cleaning fluid recovery still for separating contaminants from the cleaning fluid, a filtration system for filtering contaminants from the cleaning fluid, and said cleaning vessel, storage tank, solvent recovery still and filtration system are arranged in a plurality of modules, a liquified gas cleaning fluid line being provided to circulate cleaning fluid between separate of said modules, the liquified gas cleaning fluid line including a releasably connectable junction for permitting separation and connection of the liquified gas line and thereby the modules, said junction being arranged and configured such that the liquified gas cleaning fluid line can be releasably connected with the modules in adjacent relation in a plurality of different configurations without rerouting or otherwise altering the liquified gas cleaning fluid line or the modules.

2. The dry cleaning system of claim 1 wherein the cleaning vessel, storage tank, solvent recovery still and filtration system are arranged in first and second modules.

3. A liquified gas dry cleaning system comprising:

a cleaning vessel for containing a pressurized cleaning fluid, a storage tank for receiving and storing a cleaning fluid supply, a cleaning fluid recovery still for separating contaminants from the cleaning fluid, a filtration system for filtering contaminants from the cleaning fluid, and said cleaning vessel, storage tank, solvent recovery still and filtration system being arranged in a plurality of modules including first and second modules, a liquid cleaning fluid line being provided to circulate cleaning fluid between said first and second modules, the liquid fluid line including a junction for permitting separation and connection of the liquid fluid line and thereby the modules, and the junction being arranged and configured such that the liquid fluid line can be connected with said first and second modules arranged in side-to-side location or one behind the other without rerouting the liquid fluid line.

4. The dry cleaning system of claim 3 wherein the cleaning vessel is arranged in the first module and the storage tank and solvent recovery still are arranged in the second module.

5. The dry cleaning system of claim 4 further including a purge tank in fluid communication with the cleaning vessel for receiving gaseous cleaning fluid and wherein the filtration system is arranged in the first module and the purge tank is arranged in the second module.

6. The dry cleaning system of claim 3 wherein the liquid fluid line junction is configured as a horizontally extending flange connection.

7. The dry cleaning system of claim 6 wherein the liquid line junction is arranged in the first module.

8. The dry cleaning system of claim 7 wherein the liquid line junction is arranged such that it is spaced equidistant from a side of the first module and a back of the first module.

9. The dry cleaning system of claim 8 wherein the liquid line junction is arranged such that it is spaced from the side and back of the first module frame a distance equal to the length of the portion of the liquid line extending between the perimeter of the second module and the liquid line junction.

10. A liquified gas dry cleaning system comprising:

a cleaning vessel for containing a pressurized cleaning fluid, a storage tank for receiving and storing a cleaning fluid supply, a cleaning fluid recovery still for separating contaminants from the cleaning fluid, a filtration system for filtering contaminants from the cleaning fluid, said cleaning vessel, storage tank, solvent recovery still and filtration system are arranged in a plurality of modules, a liquid line being provided to circulate liquid cleaning fluid between separate of said modules, the liquid line including a junction for permitting separation and connection of the liquid line and thereby the modules, the junction being arranged and configured such that the liquid line can be connected with the modules in adjacent relation in a plurality of different configurations without rerouting of the liquid line, and a gas line for circulating gaseous cleaning fluid between separate of said modules, the gas line including a junction for permitting separation and connection of the gas line, and the gas line junction being arranged and configured such that the gas line can be connected with the modules in adjacent relation in a plurality of different configurations without rerouting of the gas line.

11. The dry cleaning system of claim 10 wherein the cleaning vessel, storage tank, solvent recovery still and filtration system are arranged in first and second modules, and said gas and liquid line junctions are arranged such that the gas line and the liquid line can be connected with the first and second modules arranged side-to-side or one behind the other without rerouting of the liquid and gas lines.

12. The dry cleaning system of claim 11 wherein the gas line junction is configured as a horizontal flange connection.

13. The dry cleaning system of claim 12 wherein the gas line junction is arranged in the first module.

14. The dry cleaning system of claim 13 wherein the gas line junction is arranged such that it is spaced equidistant from a side of the first module and a back of the first module.

15. The dry cleaning system of claim 14 wherein the gas line junction is arranged such that it is spaced from the side and back of the first module frame a distance equal to the length of the portion of the gas line extending between the perimeter of the second module and the gas line junction.

16. The dry cleaning system according to claim 11 wherein the gas line junction and the liquid line junction are arranged in the first module.

17. The dry cleaning system according to claim 16 wherein the gas line junction and the liquid line junction are arranged along a common vertically extending axis.

* * * * *